United States Patent [19]

Bayles

[11] 4,287,837

[45] Sep. 8, 1981

[54] FURNITURE ASSEMBLY

[76] Inventor: Richard A. Bayles, 8 Idlewild Park Dr., Cornwall-on-Hudson, N.Y. 12520

[21] Appl. No.: 98,753

[22] Filed: Nov. 30, 1979

[51] Int. Cl.[3] ..... A47B 3/06; A47B 17/00

[52] U.S. Cl. ..... 108/154; 248/188; 312/195

[58] Field of Search ..... 108/154, 155, 153; 248/188; 312/195

[56] References Cited

U.S. PATENT DOCUMENTS

| | | | |
|---|---|---|---|
| 970,721 | 9/1910 | Kirkpatrick et al. | 108/154 |
| 983,903 | 2/1911 | Horton | 108/154 |
| 1,467,830 | 9/1923 | Boggs | 108/154 |
| 1,527,094 | 2/1925 | Tomlinson | 108/154 |
| 1,828,550 | 10/1931 | Sommers | 108/154 X |

FOREIGN PATENT DOCUMENTS

| | | | |
|---|---|---|---|
| 2133140 | 1/1973 | Fed. Rep. of Germany | 312/195 |

*Primary Examiner*—William E. Lyddane
*Attorney, Agent, or Firm*—Edward F. Levy

[57] ABSTRACT

A furniture assembly, such as a knock-down work station, desk or table, which may be easily assembled without the use of tools. The furniture assembly comprises a table top, a pair of I-shaped leg members, and a modesty panel which are interfitted and attached together to form a rigid furniture unit. The table top has secured thereto a pair of elongated metal channel-shaped members depending from the bottom surface of the table-top and having a plurality of slots therein into which are inserted tabs secured to the leg members for suspending said leg members from said table top. The panel is formed with side and end panels which abut opposing surfaces of the leg members when the panel is assembled, to hold said leg members from movement. Assembly is completed by insertion of snap fastening elements into registering apertures in the leg members and panel flanges.

8 Claims, 3 Drawing Figures

FURNITURE ASSEMBLY

The present invention relates generally to knock-down furniture which is supplied to the user in disassembled form, and in particular relates to a knock-down unit of office desk or work station which is capable of being assembled by the user without tools of any kind.

A significant cost element in the distribution of conventional furniture products resides in the expenses associated with the shipment and storage of the furniture. These costs assume significant proportions as a result of the relatively large bulk, or overall volume of most furniture products, which require large warehouse and stock room space, and which are difficult to transport. To overcome these problems, furniture is often distributed and supplied in knock-down form with the parts thereof disassembled and packed in a relatively small and compact package. The purchaser must then assemble the parts into the finished furniture unit.

Although knock-down furniture products are considerably less expensive than assembled furniture, the popularity of knockdown products has suffered because of the difficulty and inconvenience encountered by the purchaser in assembling the unit. Most knock-down products include screws, nuts and bolts or similar metal fasteners which require the use of tools such as screwdrivers, pliers, socket wrenches or the like for assembly.

It is an object of the present invention to provide a knock-down furniture assembly which can be shipped and stored in a disassembled state with a minimum bulk and which can be assembled rapidly without the use of special tools.

Another object of the invention is to provide a furniture assembly which can be easily assembled, and when assembled form an exceptionally sturdy article of furniture such as a desk or work station.

Another object of the invention is the provision of a furniture assembly composed of relatively few simple parts, several of which may be identical and interchangeable, so that the assembly is unusually economical in manufacture.

A further object of the invention is the provision of a furniture assembly of the character described in which the component parts thereof are quickly and easily assembled by interfitting the parts, and in which the components are then locked together by insertion of snap-in fasteners to provide a rigid assembled article of furniture.

In accordance with the invention herein, the knock-down furniture assembly comprises a table top having a flat bottom surface to which a plurality of elongated leg support members are secured in parallel spaced relationship to each other, each of the leg support members having a plurality of spaced slots formed on one side thereof. The assembly also includes a plurality of leg members, each comprising an upright portion and an elongated or extended portion formed rigidly with the upright portion and extending perpendicularly thereto at the upper end thereof, said elongated portions having a plurality of tabs secured thereto and sized and positioned to fit within the slots of one of said leg support members. The assembly further includes a panel adapted to be mounted between said leg members in an upstanding position beneath said table top and perpendicular thereto, the panel having flange portions positioned to abut the upright portions of the respective leg members, and snap-fitting attachment elements for connecting the flange portions to said leg members.

In assembling the knock-down furniture assembly, the leg members are placed in upstanding position beneath the horizontally-disposed table top, with the elongated portions of the leg members underlying and supporting the table top, and the tabs of said elongated portions are inserted into the slots of the respective leg-support members. The panel is then placed beneath the table top with its flange portions abutting the upright portions of the leg members, and the snap-fitting attachment elements are inserted through apertures in said flange portions to connect said legs rigidly to said panel and to said table top.

Additional objects and advantages of the invention will become apparent during the course of the following specification when taken in connection with the accompanying drawings, in which.

Figure 1:
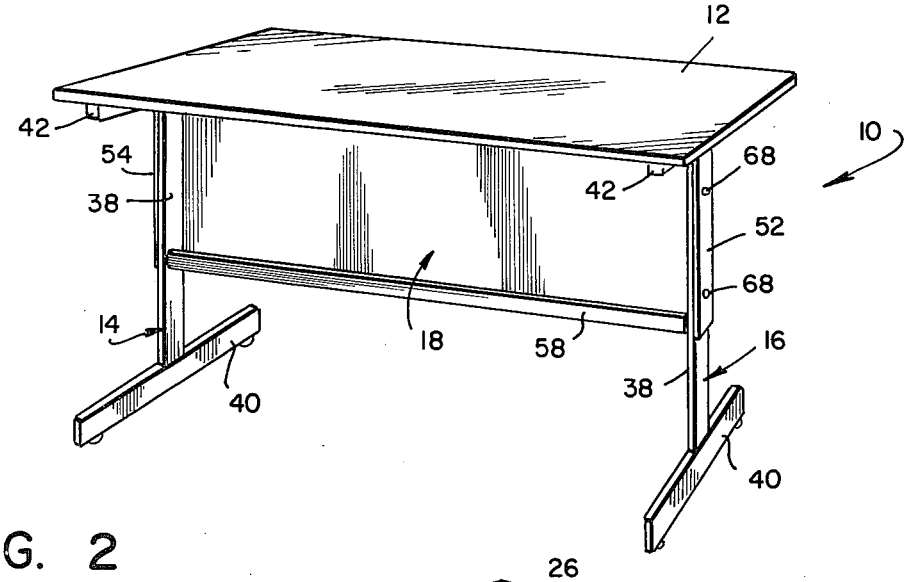
FIG. 1 is a perspective view of an assembled desk or work station, assembled from the knock-down furniture assembly of the present invention.

Referring in detail to the drawings, and particularly to FIG. 1, there is shown an article of furniture 10 formed by the components of the knock-down furniture assembly of the present invention. The article of furniture 10 is illustrated as an item of office furniture, and particularly as a desk, work station or table. The article 10 comprises a table-top 12, a pair of leg members 14 and 16, and a modesty panel 18.

The table top 12 is of conventional type being made of wood, metal or composition material, and has flat top and bottom surfaces. Secured to the bottom surface of the table top 12 are a pair of elongated leg-support members 20 and 22, each sized to extend the width of the table-top 12, as shown in FIG. 2.

Figure 2:
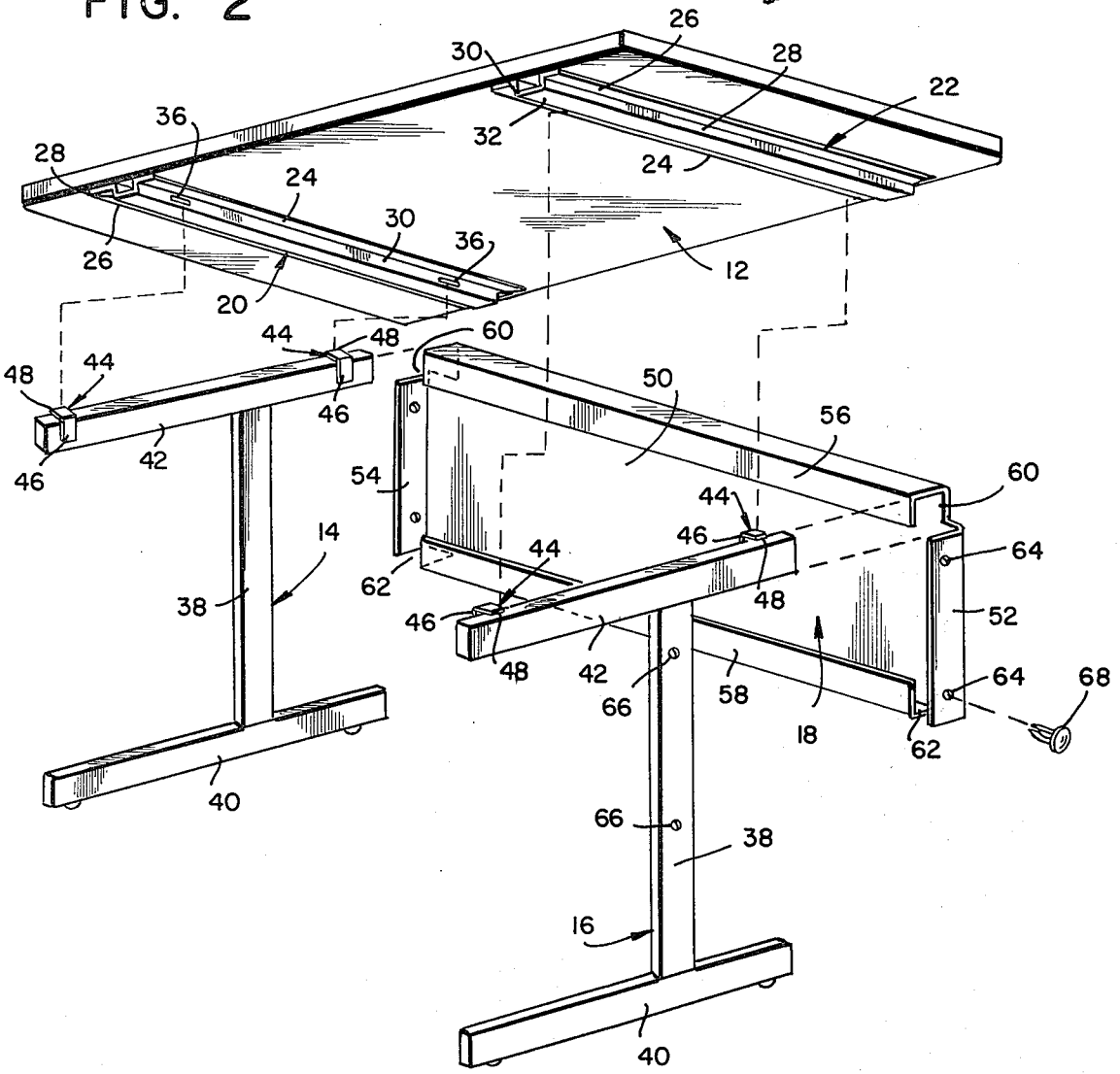
FIG. 2 is an exploded view of the components of the knock-down furniture assembly showing the manner in which these components are assembled to form the completed unit of FIG. 1.
Figure 3:
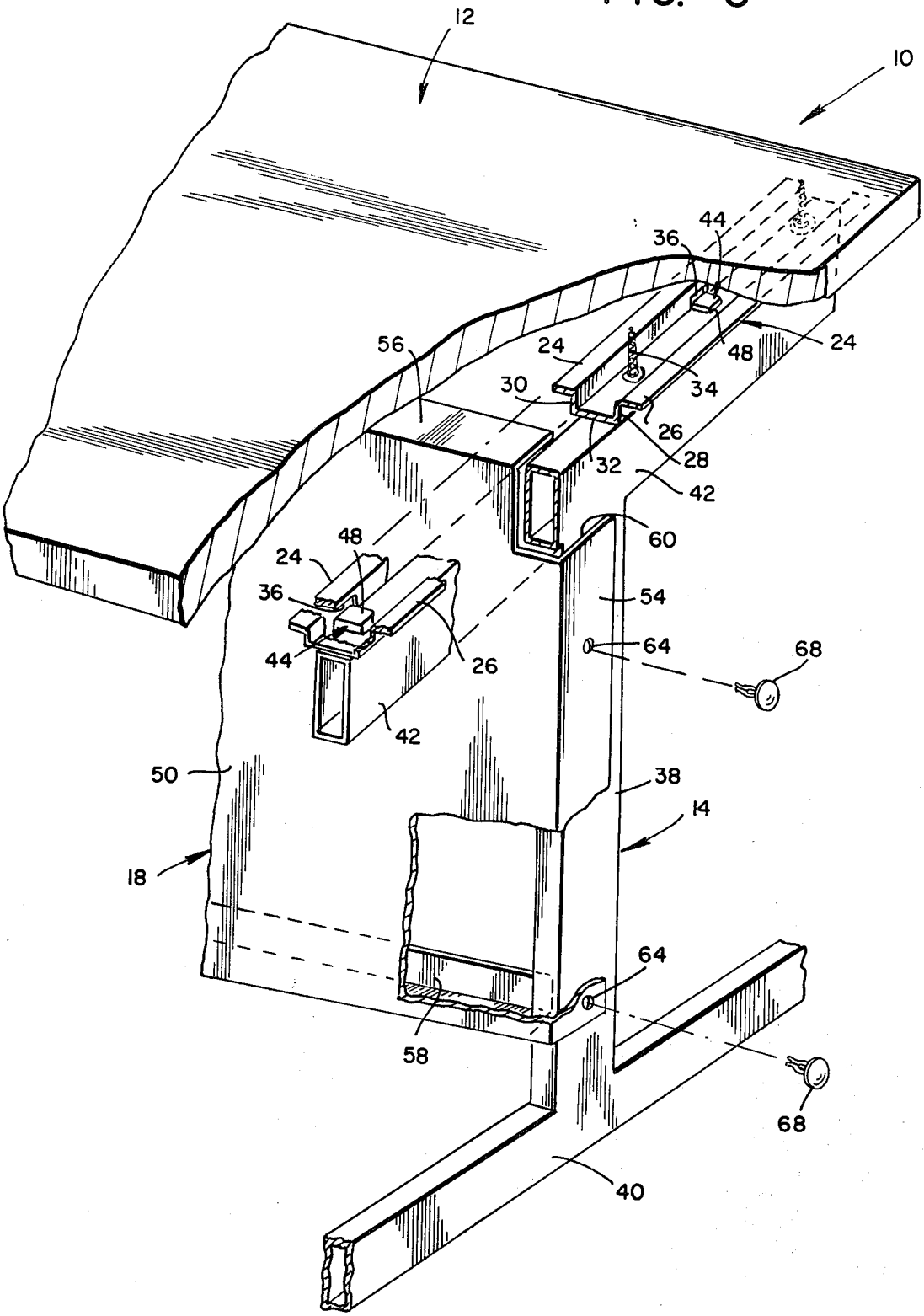
FIG. 3 is an enlarged perspective view of one end portion of the assembled desk or work station of FIG. 1, with portions thereof broken away and shown in section to reveal inner structural details.

Each leg-support member 20 and 22 is formed a plate of metal bent into the channeled hat shape shown in FIGS. 2 and 3 and comprising a pair of end flanges 24 and 26, a pair of integral side walls 28 and 30 depending perpendicularly from the inner ends of said flanges 24 and 26, and a bottom wall 32 extending between and connecting said side walls 28 and 30. The leg-support members 20 and 22 are mounted on the table-top 12 at each end portion thereof with the flanges 24 and 26 resting flush upon the under surface of the table-top. The leg-support members are secured to the table-top by screws 34 (FIG. 3) or other suitable means of attachment, and this connection is factory-made so that the table-top 12 is supplied to the user with the leg-support members 20 and 22 permanently secured thereto.

The side wall 30 of each leg-support member 20 and 22 is formed with a pair of spaced elongated slots 36 which serve to mount the leg members 14, 16 in a manner to be presently described. When the leg-support members are secured to the table top 12, they are oriented so that their side walls 30, containing the slots 36, are facing toward the center of the table-top.

Each leg member 14 and 16 has an I-shaped metal body comprising an upright leg portion 38 terminating at its bottom end in an integral base portion 40 which extends perpendicularly thereto. At its upper end, the leg portion 38 terminates in an integral table-support portion 42 which extends perpendicularly to said leg portion. The leg portion 38, base portion 40, and table-support portion 42 are each in the form of an elongated metal bar of rectangular cross-section, which may be hollow, as shown in FIG. 3.

Each table-support portion 42 has secured thereto a pair of L-shaped metal brackets 44. Each of the brackets 44 has an arm 46 which is secured to the side wall of the table-support portion 42, and a tab or arm 48 which overlies the top wall of the table-support portion and is parallel to and spaced therefrom. The brackets 44 are spaced apart the same distance as the slots 36 in the leg-support members 20 and 22, and the tabs 48 are sized to fit within said slots 36 when the components are assembled, in a manner to be presently described.

The panel 18 has a flat body portion 50 made of metal and bent at each end to form a pair of perpendicular end flanges 52 and 54, as shown in FIG. 2. The upper end of the body portion 50 is bent into the form a U-shaped channel 56, while the lower end is also bent to form a U-shaped channel 58. The upper channel extends longitudinally along the upper edge of panel 18 and terminates at each end short of the end flanges 52,54. The upper edge of each flange 52,54 terminates below the upper U-shaped channel 56, as shown in FIG. 2, to form a corner notch 60 sized to receive and seat the table-support portion 42 of leg members 14,16 when the work station is assembled. The lower edge of each flange 52,54 is spaced from the end of the lower U-shaped channel 58, providing a space 62 therebetween for receiving therein a leg portion 38 when the work station is assembled.

Each panel end flange 52 and 54 is provided with a pair of spaced apertures 64 which are positioned to register with a pair of spaced apertures 66 in the leg portion 38 of each leg member 14 and 16 when the components are assembled. Snap fasteners 68 are provided for insertion through the registering apertures 64 and 66, whereby to secure the panel 18 to the leg members, as shown in FIGS. 2 and 3. Each snap fastener element 68 is in the form of a pop-in plug of the usual commercial type which has an expanded partially-split shank sized to be slid through the aligned apertures 64 and 66, with the expanded shank being compressed during insertion and thereafter spreading to lock the fastener element 68 within the apertures 64,66.

In assembling the desk or work station 10, the leg members 14 and 16 are brought beneath the horizontally-disposed table top 12, and the tabs 48 of the L-shaped brackets 44 mounted on leg members 14,16 are inserted into the elongated slots 36 of the respective leg-support members 20 and 22 mounted on the under surface of the table top 12. The L-shaped brackets 44 are so sized and positioned, that in the inserted positions of the tabs 48 within the slots 36, the bottom walls 32 of the leg-support members 20 and 22 rest flush upon the upper surfaces of the table support portions 42 of the respective leg members 14 and 16, as shown in FIG. 3. The inserted tabs 48 hold the leg members 14 and 16 against vertical movement away from the table top 12.

The modesty panel 18 is then assembled by bringing it beneath the rear end of the table top 12 with the table support portions 42 of the upstanding leg members 14,16 received in the corner notches 60, and the panel is then slid forwardly until the upright leg portions 38 of the leg members enter the spaces 62 and are snugly received therein. In this position, the apertures 64 in the panel flanges 52 are aligned with the apertures 66 in the leg portions 38. As shown in FIG. 3, in this assembled condition, the end edges of the upper U-shaped channels 56 abut the inner surface of the leg member table support portions 42 and the end edges of the lower U-shaped channels 58 abut the inner surfaces of the leg portions 38, thereby restraining the leg members 14 and 16 from inward movement toward the center of the table top 12. At the same time, the panel end flanges 52 and 54 overlie and abut the outer surfaces of the leg portions 38 of the respective legs 16 and 14, thereby restraining the leg members from outward movement relative to the table top.

A fastener member 68 is then snap-fitted into each of the aligned pairs of apertures 64 and 66 to lock the modesty panel to the leg members 14 and 16, thereby completing the assembly of the article of furniture as a rigid final product. The L-shaped brackets 44 secure the table-top 12 to the leg members 14 and 16, and the modesty panel 18 rigidifies the structure and secures the leg members rigidly in their spaced relationship against any undesirable movement.

It will thus be seen that the components of the knock-down furniture assembly may be stored and shipped in flat, compact form, and that the user may quickly and easily assemble the components without the use of tools, by merely slip-fitting the leg members in position beneath the table top, and snap-fitting the fastener members within the aligned apertures.

The article of furniture 10 shown in FIG. 1 may serve as a work station, desk or table, and may be provided with drawers, cabinet compartments or the like suspended from the table top.

While a preferred embodiment of the invention has been shown and described herein, it is obvious that numerous additions, changes and omissions may be made in such embodiment without departing from the spirit and scope of the invention.

What is claimed is:

1. A furniture assembly comprising a table top having a flat bottom surface a plurality of elongated leg-support members secured to the bottom surface of said table top in parallel, spaced relationship to each other, each of said leg-support members having a plurality of spaced slots formed in one side thereof, a plurality of leg members, each comprising an upright portion and an upper elongated portion formed rigidly with said upright portion and extending perpendicularly thereto at the upper end thereof, a plurality of tabs secured to said upper elongated portions and sized and positioned to fit within the slots of one of said leg-support members, a panel adapted to be mounted between said leg members in an upstanding position beneath and perpendicular to said table top, said panel having flange portions positioned to abut the upright portions of the respective leg members, and snap-fitting attachment means for connecting said flange portions to said leg members to maintain said leg members in a fixed relationship when said leg members are assembled with said table top.

2. A furniture assembly according to claim 1 in which said leg-support members include a U-shaped body portion having perpendicular terminal flanges, said leg-support members being secured to said table top with said flanges abutting the bottom surface of said table top and the U-shaped body portion depending therefrom, said slots being formed in one side wall of said U-shaped body portion.

3. A furniture assembly according to claim 1 in which each of said leg members has an I-shaped body including said upright portion, said upper elongated portion formed integrally with said upright portion and extending perpendicularly across the top end thereof, and an elongated base portion formed integrally with the upright portion and extending perpendicularly across the bottom end thereof.

4. A furniture assembly according to claim 2 in which the upright portion and upper elongated portion of each leg member is of rectangular cross section, and in which a plurality of L-shaped brackets are secured to said upper elongated portion with one arm thereof overlying and spaced above the top surface of said upper elongated portion and constituting said tab, said tabs being positioned for insertion into the slots of the respective leg-support members for mounting said table top upon said leg members with the leg-support members resting upon the upper elongated portions of said leg members and said inserted tabs restraining said leg members from movement away from said table top and from movement longitudinally of said leg-support members.

5. A furniture assembly according to claim 4 in which said panel comprises a flat body bent perpendicularly at each end to provide said flange portions, and having a U-shaped channel formed at the top and bottom edges thereof, said panel being insertible upon the mounted leg members with said flange portions overlying the outer surfaces of the upright portions of the respective leg members and the ends of said U-shaped channels overlying the inner surfaces of said leg members, whereby said flange portions and channels of said panel restrain said leg members against transverse movement toward and away from each other.

6. A furniture assembly according to claim 5 in which the ends of the upper U-shaped channel are spaced from said flange portions to provide an access opening for receiving the upper elongated portions of said leg members when said panel is inserted upon the mounted leg members.

7. A furniture assembly according to claim 5 in which the upright portions of said leg members have a plurality of apertures therein, and in which the flange portions of said panel have a plurality of apertures therein positioned to register with the leg member apertures when said panel is inserted upon said leg members, said snap fastening attachment means being insertible through said registering apertures.

8. A furniture assembly according to claim 7 in which said snap fastening attachment means comprises a plurality of plug members being expanded, partically-split shanks sized to be slid under compression through a pair of said registering apertures.

* * * * *